United States Patent [19]

Kusumoto et al.

[11] Patent Number: 4,801,972

[45] Date of Patent: Jan. 31, 1989

[54] IMAGE FORMING APPARATUS EQUIPPED WITH A PLURALITY OF DEVELOPING UNITS

[75] Inventors: Keiji Kusumoto; Yoshiaki Takano, both of Toyokawa, Japan

[73] Assignee: Minolta Camera Kabushiki Kaisha, Osaka, Japan

[21] Appl. No.: 101,678

[22] Filed: Sep. 28, 1987

[30] Foreign Application Priority Data

| | | | |
|---|---|---|---|
| Oct. 6, 1986 | [JP] | Japan | 61-236175 |
| Oct. 6, 1986 | [JP] | Japan | 61-236176 |
| Oct. 13, 1986 | [JP] | Japan | 61-241281 |
| Oct. 13, 1986 | [JP] | Japan | 61-241282 |

[51] Int. Cl.[4] ..... G03G 15/01; G03G 15/09

[52] U.S. Cl. ..... 355/14 D; 355/4; 355/3 DD

[58] Field of Search ..... 355/4, 3 DD, 14 D, 3 R; 118/645

[56] References Cited

U.S. PATENT DOCUMENTS

| | | | |
|---|---|---|---|
| 4,652,113 | 3/1987 | Watanabe | 355/4 X |
| 4,710,016 | 12/1987 | Waatanabe | 355/4 |
| 4,713,673 | 12/1987 | Kessoku | 355/4 |

*Primary Examiner*—R. L. Moses

*Attorney, Agent, or Firm*—Burns, Doane, Swecker & Mathis

[57] ABSTRACT

An electrophotographic image forming apparatus capable of bringing one developing unit among a plurality of developing units thereof into an operative state.

To accomplish the developing unit changeover operation in the least necessary time, control means accepts an image forming operation start signal during the developing unit changeover operation to start the image forming operation immediately after the completion of the developing unit changeover operation and accepts a selection signal selecting an another developing unit during the developing unit changeover operation. Furthermore, when the developing unit changeover operation for bringing a developing unit into an operative state is interrupted and then the same developing unit is assigned again to operation, the developing unit changeover operation subsequent to the interruption of the developing unit changeover operation process is carried out in a time corresponding to the residual time in a time allocated for the interrupted developing unit changeover operation.

9 Claims, 14 Drawing Sheets

FIG.4
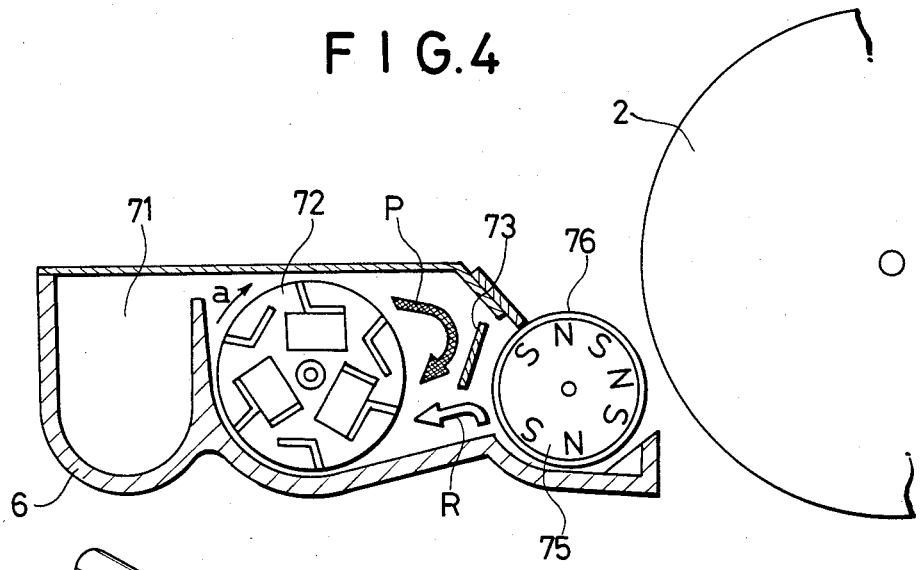
FIG.5
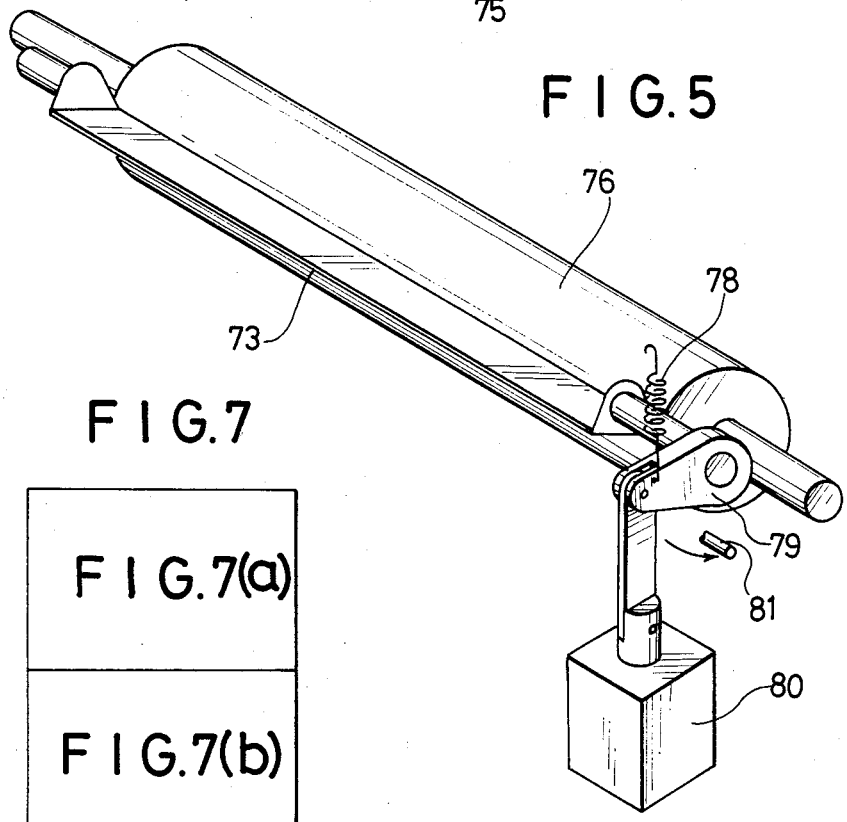
FIG.7
| |
|---|
| FIG.7(a) |
| FIG.7(b) |

IMAGE FORMING APPARATUS EQUIPPED WITH A PLURALITY OF DEVELOPING UNITS

BACKGROUND OF THE INVENTION

1. Field of the Invention

The present invention relates to an image forming apparatus equipped with a plurality of developing units which are used selectively.

2. Description of Related Art:

There has been known an electrophotographic image forming apparatus equipped with a plurality of developing units for producing color copies in addition to monochromic copies, which are used selectively by operating selection keys provided on a control panel to operate desired developing units. In such an image forming apparatus, operation of a print key to command the image forming apparatus to start the copying operation is invalid while the developing unit changeover operation is executed in response to the operation of a developing unit selecting key. Therefore, the print key must be operated to start the copying operation after the developing unit changeover operation has been completed. Furthermore, once an incorrect developing unit selection signal is entered by operating the selection key to select a wrong developing unit, the developing unit selecting procedure needs to be repeated again to select a correct developing unit after the completion of the developing unit changeover operation for selecting the wrong developing unit, because the developing unit changeover operation is started upon the entry of a developing unit selection signal by operating the selection key. Several seconds necessary for the developing unit changeover operation is a significant loss in operating time which cannot be ignored, and the unnecessary repetition of the developing unit changeover operation entails the useless wear of the components.

Still further, in the conventional image forming apparatus of such a type, the changeover of the developing unit, for example, from a developing unit for the monochromatic copying operation by use of black developer to a developing unit for the color copying operation by use of color developer requires a so-called magnetic brush removing operation for recovering black developer remaining on the developing sleeve before starting the color copying operation. Imperfect removal the residual developer causes muddy color copies with black developer and hence it is impossible to produce clear color prints. Accordingly, a fixed time on the order of several seconds is allocated for the developing unit changeover operation so that the developer remaining on the developing sleve is removed completely.

Accordingly, when the change over of the developing unit is required in such a conventional image forming apparatus, a time necessary for the developing unit changeover operation is spent unavoidably before operating the print start key to start the printing operation, which has been an impediment to efficient copying operation.

Furthermore, in the conventional image forming apparatus, the developing unit changeover operation can be interrupted by operating an interrupt key when the operator becomes aware that the developing unit changeover operation is unnecessary after the developing unit changeover operation has been started. However, when the developing unit which has been operative before the interrupted developing unit changeover operation is selected again, the entire developing unit changeover operation requiring a predetermined time is repeated. In such a case, the developer remaining on the developing sleeve is recovered to some extent during the interrupted developing unit changeover operation and hence the subsequent developing unit changeover operation can be accomplished in a time shorter than the predetermined time for the normal developing unit changeover operation. Nevertheless, the developing unit changeover operation subsequent to the interruption of the preceding developing unit changeover operation is continued for the predetermined time for the normal developing unit changeover operation before the operation of the print start key becomes valid unnecessarily wasting time.

SUMMARY OF THE INVENTION

Accordingly, it is an object of the present invention to provide an image forming apparatus incorporating improvements in developing unit changeover operation.

It is another object of the present invention to provide an image forming apparatus capable of accepting a further developing unit changeover command, print start command and developing unit changeover operation interrupting command during the developing unit changeover operation.

It is a further object of the present invention to provide an image forming apparatus capable of properly carrying out the developing unit changeover operation according to a developing unit changeover command and a print start command.

These and other objects of the present invention are achieved by an image forming apparatus equipped with a plurality of developing units which are selectively brought into an operative state one at a time, comprising:

developing unit selecting signal input means for giving a developing unit selecting signal designating one developing unit among the plurality of developing units; developing unit changeover means which executes a developing unit changeover operation according to the developing unit selecting signal to bring the selected developing unit into an operative state and to bring the rest of the developing unit into an inoperative state; and control means for controlling the developing unit changeover means, when another developing unit selecting signal requesting the selection of another developing unit is given during the developing unit changeover operation, so as to make the developing unit changeover means interrupt the developing unit changeover operation in process and execute another developing unit changeover operation for bringing the newly selected developing unit into an operative state.

BRIEF DESCRIPTION OF THE DRAWINGS

FIGS. 3 and 4 are sectional views of the developing unit of FIG. 2;

FIG. 5 is a perspective view of a shutter mechanism incorporated into the developing unit of FIG. 2;

DESCRIPTION OF THE PREFERRED EMBODIMENTS

The preferred embodiments of the present invention will be described hereinafter with reference to the accompanying drawings.

Figure 1:
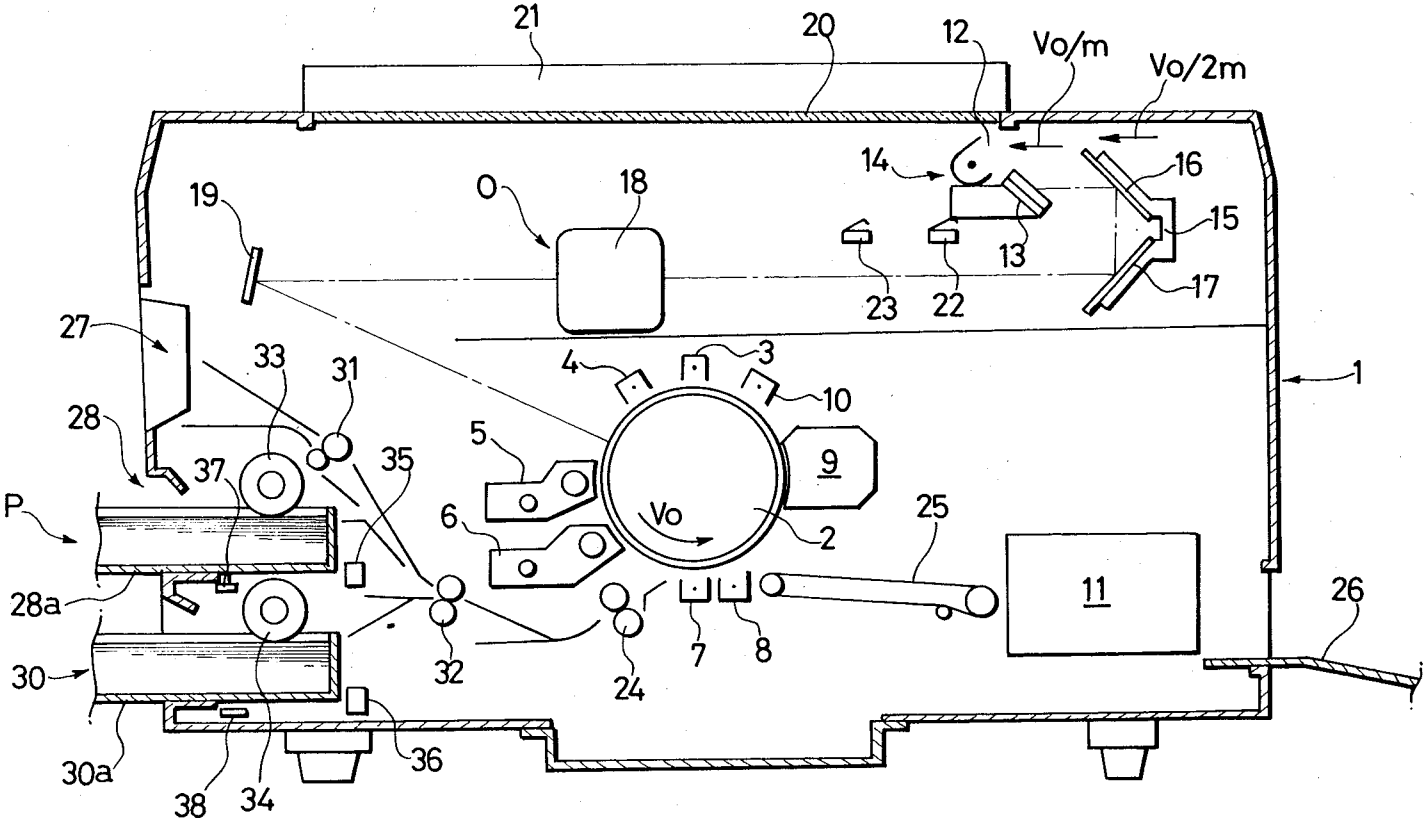
FIG. 1 is a schematic sectional view showing the principal constitution of an image forming apparatus according to the present invention.

Referring to FIG. 1, indicated at 1 is an image forming apparatus and at 2 is a photosensitive drum which is driven by a main motor, not shown, for rotation in a counterclockwise direction. Sequentially disposed at intervals around the photosensitive drum along the direction of rotation of the photosensitive drum 2 are a main charger 3, a blank eraser 4, a first developing unit 5, a second developing unit 6, a transfer charger 7, a separating charger 8, a cleaning device 9, and a main eraser 10. An optical system 0 is disposed above the photosensitive drum 2 and the peripheral components. A copying paper feed system P is disposed on the left-hand side of the photosensitive drum 2, and a fixing unit 11 is a disposed on the right-hand side of the photosensitive drum 2. The image forming apparatus may be equipped with three or more developing units.

The optical system 0 comprises a scanning unit 14 comprising an integral assembly of a slit exposure type light source 12 and a first movable mirror 13, second and third movable mirrors 16 and 17 held on a holder 15, a lens 18, and a fixed mirror 19. An area in the circumference of the photosensitive drum 2 corresponding to a document placed on a contact glass 20 and held in place with a document holder 21 is charged with static electricity of positive polarity by the main charger 3. The static charge in an area in the circumference of the photosensitive drum 2 corresponding to a blank area on the contact glass 20 is erased later by the blank eraser 4. Then the light source 12 is turned on and the scanning unit 14 is moved to the left, as viewed in FIG. 1, by a scanning motor, not shown, to scan the document placed on the contact glass 20 to form an electrostatic latent image corresponding to the image of the document on the photosensitive drum 2.

The traveling speed of the scanning unit 14 is regulated so as to meet a relation: $V=V_0/m$, where V is the traveling speed of the scanning unit 14, $V_0$ is the circumferential speed of the photosensitive drum 2, and m is a copying magnification. During the scanning operation of the scanning unit 14, the second and third movable mirrors 16 and 17 are moved to the left, as viewed in FIG. 1, at a speed of $V_0/2m$. When located at a fixed starting position, the scanning unit 14 actuates a position detecting switch 22. When actuated, the position detecting switch 22 gives a position detection signal "1" indicating the location of the scanning unit 14 at the starting position to a first CPU 200, which will be described hereinafter. A timing switch 23 is provided to generate a timing signal for synchronizing the operation of the copying paper feed system P with the scanning operation of the optical scanning system O. The scanning unit 14 actuates the timing switching 23 after moving a predetermined distance from the starting position, then the timing switch 23 gives a timing signal "1" to the first CPU 200.

The first developing unit 5 and the second developing unit 6 are employed selectively for copying operation. Toner charged in negative polarity is supplied by either the first developing unit 5 or the second developing unit 6 to the circumference of the photosensitive drum 2 to visualize (to develop) the electrostatic latent image and thereby a toner image corresponding to the image of the document is formed in the circumference of the photosensitive drum 2. Subsequently, the toner image is transferred by the transfer charger 7 to a copying sheet, not shown, fed in synchronism with the timing signal to the photosensitive drum 2 by a timing roller 24, which is disposed at the rear end of the copying paper feed system P with respect to the direction of feed of a copying sheet. Then, the copying sheet carrying the toner image is separated from the circumference of the photosensitive drum 2 by the separating charger 8. Then, the copying sheet is conveyed by a conveyor belt 25 to a fixing unit 11, which heat-fixes the toner image on the copying sheet. Then, the copying sheet carrying the fixed toner image is delivered to a tray 26.

The toner remaining on the circumference of the photosensitive drum 2 is removed by the cleaning device 9. The residual static charge on the circumference of the photosensitive drum 2 is eliminated by the main eraser 10, which is continuously operative while the main motor is operating.

The copying paper feed system P has a hand-feed unit 27, a first paper feed unit 28 of a cassette type (hereinafter, referred to simply as "first feed unit") an a second paper feed unit 30 of a casette type (hereinafter referred to simply as "second feed unit"). A copying sheet fed by the hand-feed unit 27 is conveyed through a hand-feed roller 31 and an intermediate roller 32 to the timing roller 24. Copying sheets contained in cassettes 28*a* and 30*a* respectively provided in the first paper feed unit 28 and in the second paper feed unit 30 are fed by a first feed roller 33 and a second feed roller 34, respectively, through the intermediate roller 32 to the timing roller 24.

The rollers 24, 31, 32, 33 and 34 are connected to or disconnected from a driving system driven by the main motor by clutches, respectively. When the clutches are engaged, the corresponding rollers are connected to the driving system and are driven for rotation by the main motor. Paper size detectors 35 and 36, respectively, for detecting the size of copying sheets contained in the cassettes 28*a* and 30*a*, and paper exhaustion detectors 37 and 38, respectively, for detecting the exhaustion of the cassettes 28*a* and 30*a* are provided near the cassettes 28*a* and 30*a*, respectively.

Figure 2:
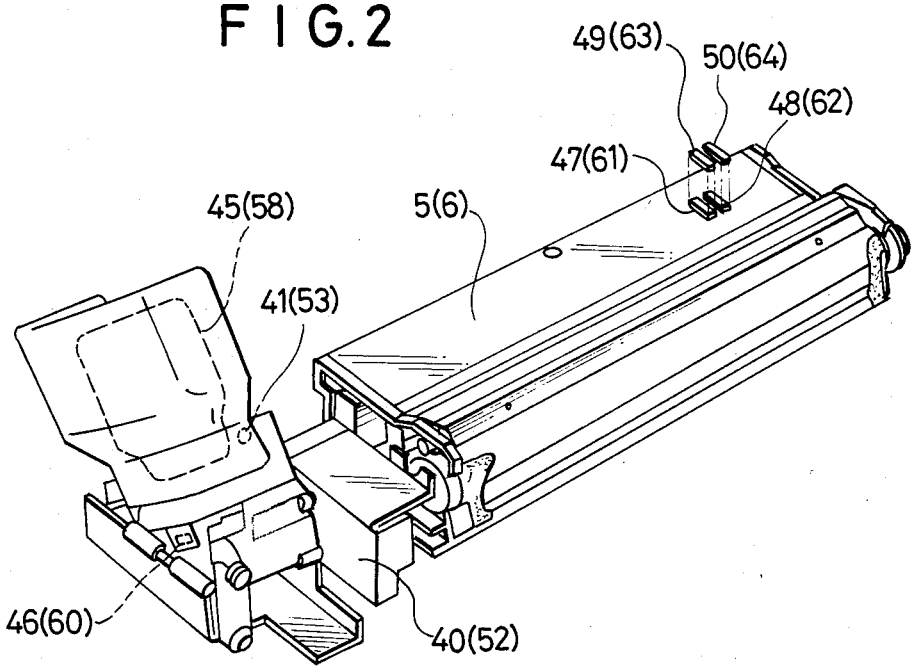
FIG. 2 is a prespective view showing the external appearance of a developing unit incorporated into the image forming apparatus of FIG. 1.

The constitution of the developing units will be described hereinafter. Since the first developing unit 5 and the second developing unit are substantially the same in constitution, only the first developing unit 5 will be described herein to avoid duplication. In FIG. 2 showing the external appearance of the first developing unit 5, parenthesized reference numerals indicate the components of the second developing unit 6.

A bracket 40 is provided at one longitudinal end of the first developing unit 5. A toner replenishing bottle 45 for replenishing the first developing unit 5 with toner is mounted detachably on the bracket 40 and is rotated by a replenishing motor, not shown, for supplying toner to the first developing unit 5. A developing motor, not shown, drives a conveying device to convey the toner supplied from the toner replenishing bottle 45 into the first developing unit 5, stirs the toner and rotates a developing sleeve.

A first bottle detector 41 for detecting the toner replenishing bottle 45 as mounted on the bracket 40, and a first toner exhaustion detector 46 for detecting the exhaustion of the toner replenishig bottle 45 are provided near the toner replenishing bottle 45.

Toner identifying magnets 47 and 48 for identifying the color of the toner supplied to the first developing unit 5 can be mounted on top of the casing of the first developing unit 5. First and second reed switches 49 and 50 which are actuated by the toner identifying magnets 47 and 48, respectively, are disposed opposite to the toner identifying magnets 47 and 48, respectively, on the frame of the image forming apparatus. For example, when black toner is supplied to the first developing unit 5, both the magnets 47 and 48 are mounted on the casing to turn both the first and second reed switches 49 and 50 on to provide an identification signal indicating that black toner is supplied to the first developing unit 5. Since four conditions can be indicated with the combination of two magnets 47 and 48, four kinds of toners of different colors can be identified with the two magnets 47 and 48.

The construction of the developing units 5 and 6 will be described hereinafter with reference to FIGS. 3 and 4. The construction of the second developing unit 6 will be described first.

Suppose that second developing unit 6 is charged with black toner and is disposed on the down stream side of the first developing unit 5 charged with color toner with respect to the direction of rotation of the photosensitive drum 2.

Figure 3:
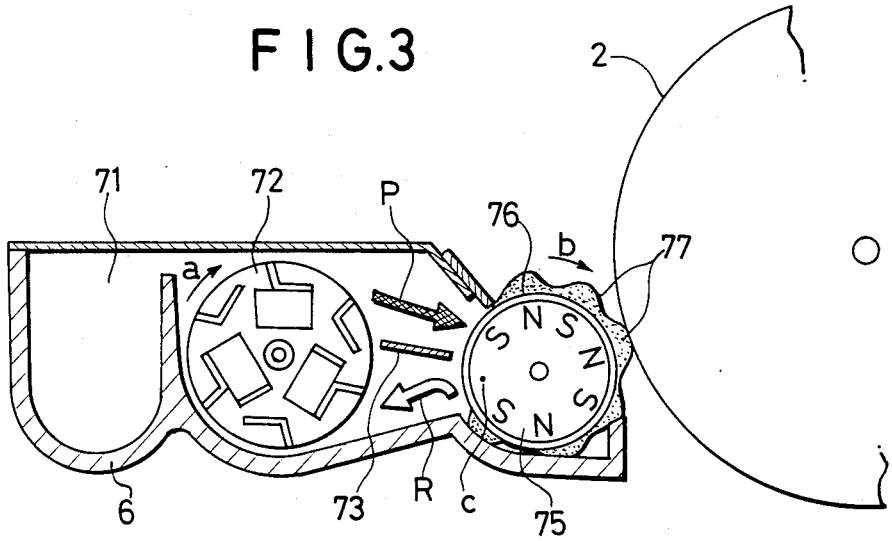

Referring to FIG. 3, the toner supplied into a toner supply channel 71 from the toner replenishing bottle 58 is conveyed by a screw conveyor or the like, not shown, so that the toner is supplied uniformly over the entire width of the photosensitive drum 2. Also, shown in FIG. 3 are a stirring bucket 72 for stirring the toner and magnetic carrier, and a shutter 73 for permitting the flow of the developer, namely, a mixture of the toner and the magnetic carrier, to the developing sleeve 76 and for intercepting the flow of the developer to the developing sleeve 76.

FIG. 5 is a perspective view showing the shutter 73 and the associated pats. Normally, the shutter 73 is positioned at an open position (FIG. 3) by an arm 79 connected to the shutter 73 and pulled up by a spring 78. In executing a magnetic brush removing operation to bring the second developing unit 6 to an inoperative state, the solenoid 80 is energized to pull down the arm 79 to a position where the arm 79 rests on a stopper 81, so that the shutter 73 is shifted to a closed position as shown in FIG. 4.

In FIGS. 3 and 4, indicated at 75 is a cylindrical magnet having seven magnetic poles on the circumference thereof. The developing sleeve 76 receives the magnet 75 therein and is driven for rotation by the developing motor, not shown.

When the second developing unit 6 is in an operative state, the stirring bucket 72 and the developing sleeve 76 are rotated in directions indicated by arrows a and b, respectively, to supply the developer from the stirring bucket 72 over the shutter 73 to the developing sleeve 76 as indicated by an arrow P. The developer supplied to the developing sleeve 76 is conveyed in the direction of the arrow b as the developing sleeve 76 is rotated. Magnetic brushes 77 are formed on the circumference of the developing sleeve 76 at positions corresponding to the magnetic poles of the magnet 75. The magnetic brushes 77 touch and adhere to the electrostatic latent image formed in the circumference of the photosensitive drum 2 to develop the electrostatic latent image. The residual developer is conveyed further as the developing sleeve 76 is rotated, falls off the developing sleeve 76 at a position C where no magnetic pole is provided on the magnet 75, and then flows in the direction of an arrow R into the stirring bucket 72.

When the second developing unit 6 is brought to an inoperative state, the shutter 73 is moved to the closed position (FIG. 4), so that the developer is not supplied to the developing sleeve 76 even if the stirring bucket 72 is rotated, the developer remaining the developing sleeve 76 falls off the developing sleeve 76 at the position C where no magnetic pole is provided on the magnet 75, flows in the direction of the arrow R, and is recovered into the stirring bucket 72. Thus, no developer remains on the developing sleeve 76. When the developing sleeve 76 is stopped after all the developer has been removed from the developing sleeve 76, no developer is supplied to the developing sleeve 76 even if the solenoid 80 is turned off to return the shutter 73 to the open position shown in FIG. 3.

In bringing the second developing unit 6 again to the operative state, the magnetic brushes 77 are formed instantly in the circumference of the developing sleeve 76 immediately after the start of rotation of the developing sleeve 76.

The first developing unit 5 is provided with a fixed guide plate at a position corresponding to the open position of the shutter 73 of the second developing unit 6 instead of the shutter 73. The rest of the constitution of the first developing unit 5 is the same as that of the second developing unit 6.

Since the first developing unit 5 is charged with color toner, the first developing unit 5 is brought into an operative state for developing the electrostatic latent image in a color image. When operative, the first developing unit 5 operates in a manner similar that of the operation of the second developing unit 6. When the first developing unit 5 is brought into an operative state, the second developing unit 6 remains in an inoperative state and hence black magnetic brushes are not formed on the developing sleeve of the second developing unit 6. Therefore, the clearness of the color toner image is not affected by the second developing unit 6. When the second developing unit 6 is employed for developing an electrostatic latent image formed on the photosensitive drum 2, and the first developing unit 5 remains in an inoperative state, the developing sleeve thereof is stopped and the developing bias of the first developing unit 5 is changed to make the adhesion of the toner of the first developing unit 5 to the electrostatic latent image difficult. Consequently, the color toner of the first developing unit 5 will not adhere to the electrostatic latent image even if color magnetic brushes are formed on the developing sleeve of the first developing unit 5 and the electrostatic latent image is developed with the black developer of the second developing unit 6 without any practical trouble.

Figure 6:
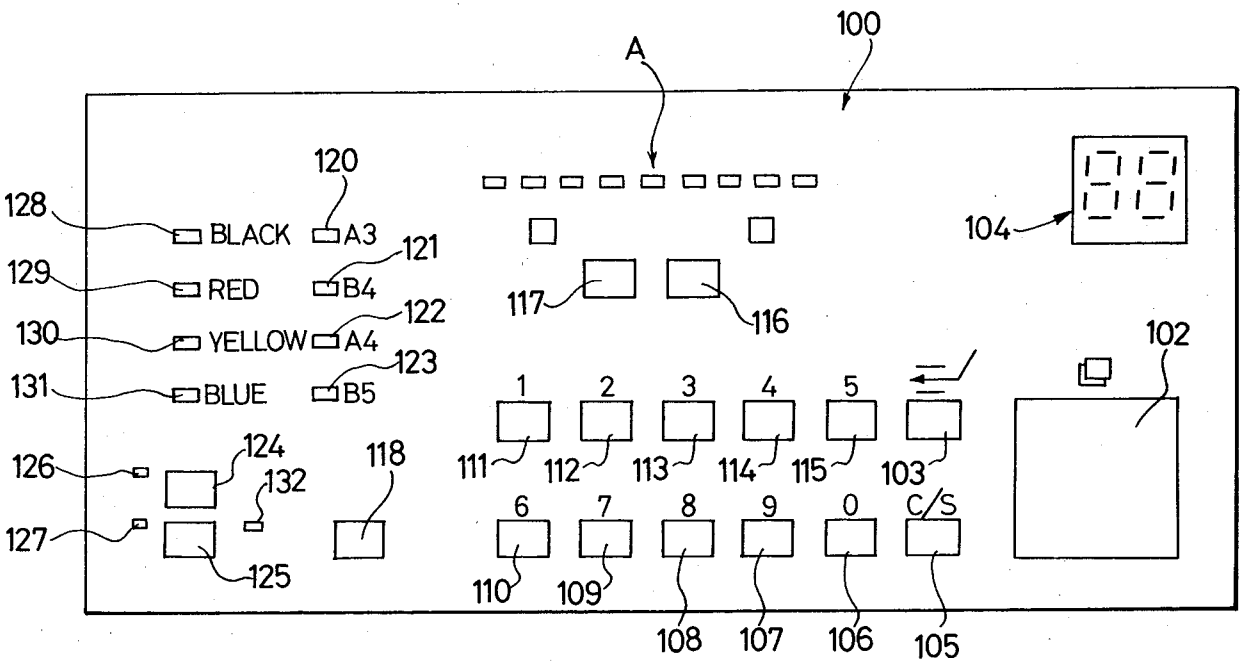
FIG. 6 is a plan view of the control panel of the image forming apparatus of FIG. 1.

The control panel 100 of the image forming apparatus 1 will be described hereinafter with reference to FIG. 6.

The control panel is provided in the upper part of the image forming apparatus 1. Arranged on the control panel 100 are a print start key 102 for giving a print start command, an interrupt key 103, a display 104 comprising a plurality of LEDs for indicating a set number of copies, a clear/stop key 105 for interrupting the copying operation of the image forming apparatus immediately after the start of copying operation or interrupting copying operation of a multicopy mode (a mode in which a plurality of copies of a single document are produced successively), for clearing the set number of copies indicated on the display 104, and for resetting the image forming apparatus 1 for a standard copying mode "1", numeric keys 106 to 115 for entering the number of copies to be produced, an exposure up key 116 for increasing exposure, an exposure down key 117 for decreasing exposure, a group A of LEDs (light emitting diodes) which are lit up selectively to indicate the current exposure, a paper feed unit selecting key 118 for selecting either the first paper feed unit 28 or the second paper feed unit 30, LEDs 120 to 123 for indicating the size of copying paper to be fed by the selected copying paper feed unit, a first developing unit selecting key 124 for selecting the first developing unit 5, a second developing unit selecting key 125 for selecting the second developing unit 6, a LED 126 which is lit up when the first developing unit 5 is selected, a LED 127 which is lit up when the second developing unit 6 is selected, LEDs 128 to 131 for indicating the color of the toner of the selected developing unit, and a LED 132 which is lit up when the toner replenishing bottle 45 mounted on the first developing unit 5 or the toner replenishing bottle 58 mounted on the second developing unit 6 is empty. Although the LEDs 128 to 131 corresponding to four color toners are provided on the control panel in this embodiment, only those corresponding to the developing units provided in the image forming apparatus function.

Figure 7A:
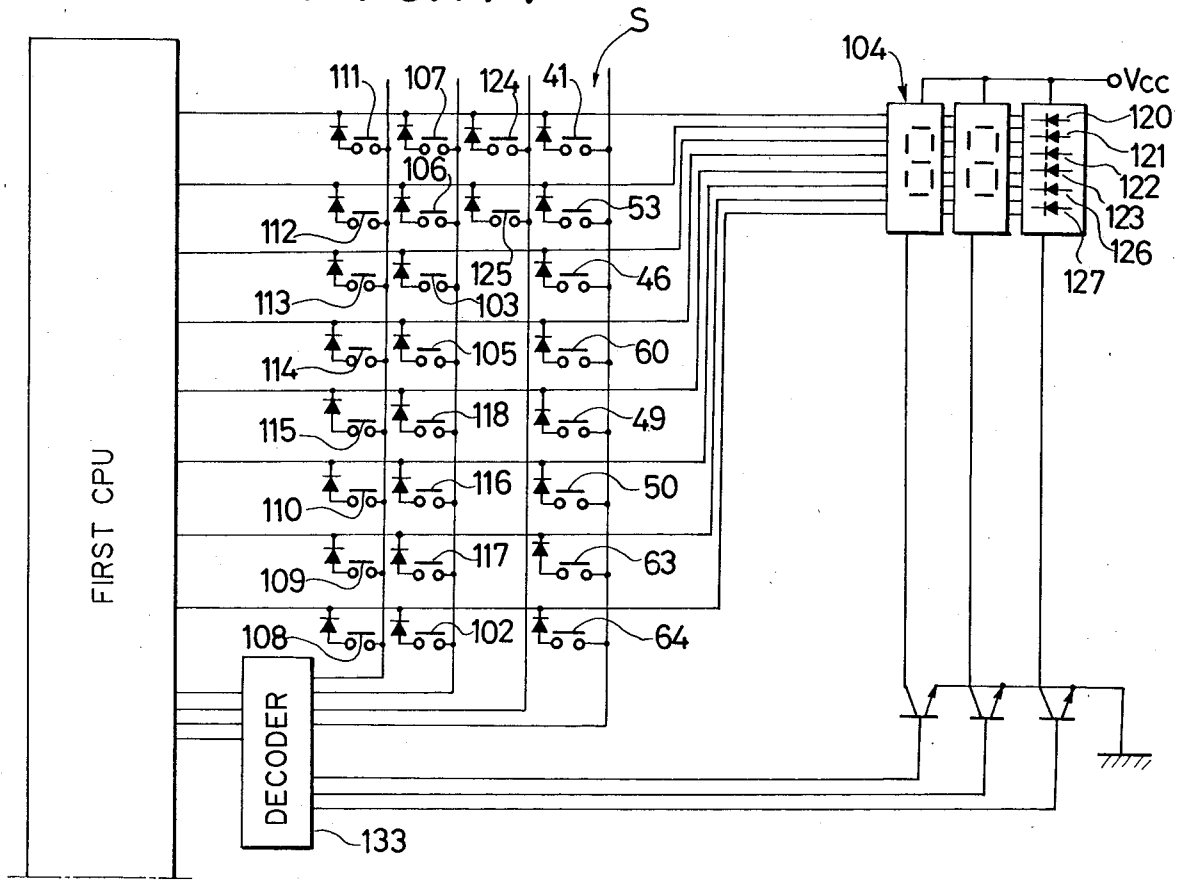
FIGS. 7 and 7(*a*) and 7(*b*) is a block diagram of the control circuit of the image forming apparatus of FIG. 1.
Figure 7B:
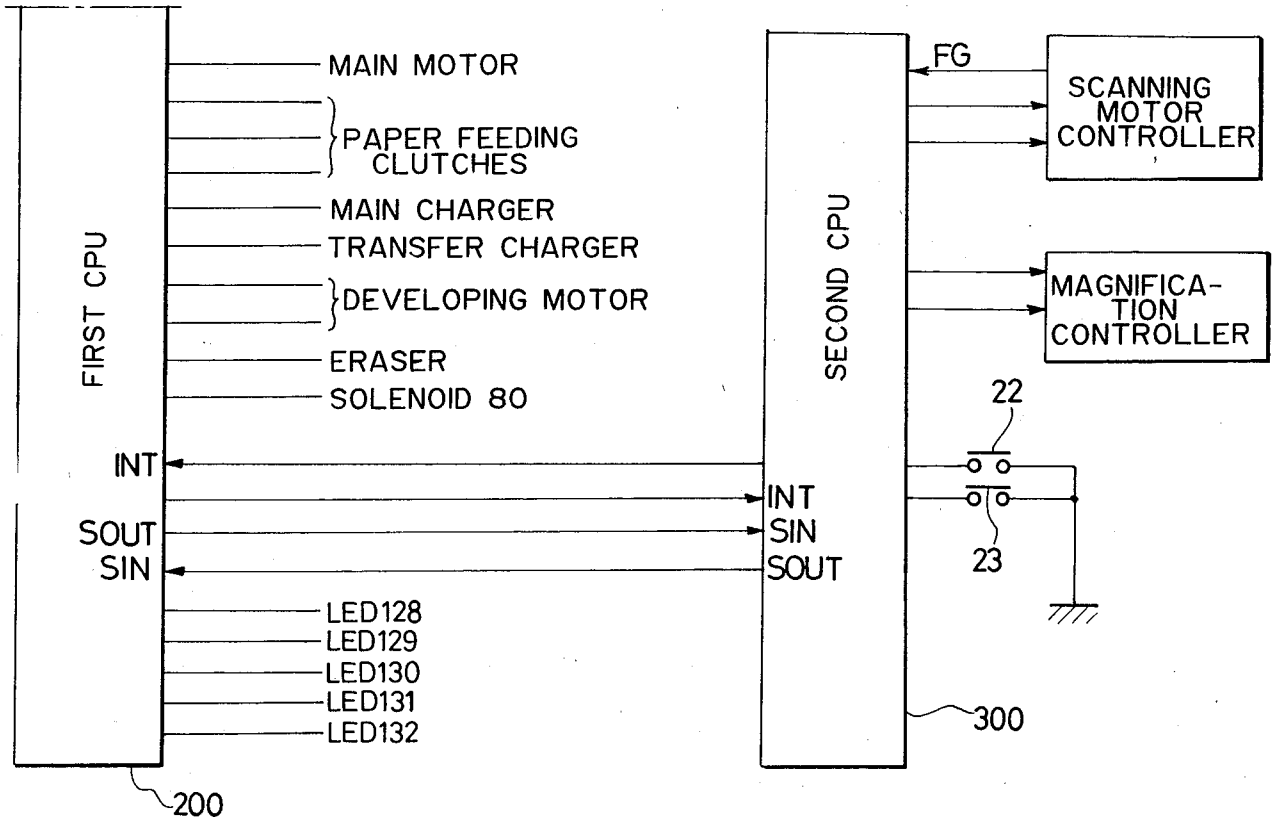

Referring to FIG. 7 showing a control circuit in a block diagram, the control circuit has a first CPU (central processing unit) 200 and a second CPU 300. In this embodiment, the first CPU 200 and the second CPU 300 are microprocessors. A switch matrix S including switches operated by the keys provided on the control panel 100, the first bottle detector 41, the second bottle detector 53, the first toner exhaustion detector 46, the second toner exhaustion detector 60, the first reed switch 49, the second reed switch 50, the third reed switch 63 and the fourth reed switch 64 which are arranged in a matrix are connected to the first CPU 200. The first CPU 200 controls the respective operations of the main motor, clutches for connecting the rollers to and disconnecting the same from the driving system, and the solenoid actuator 80 according to operation of the keys and the action of the detectors. The LEDs including those of the display 104 are turned on and off by the first CPU 200 through a decoder 133.

The position detecting switch 22 and the timing switch 23 are connected to the second CPU 300. Mainly, the second CPU 300 controls the operation of the optical system 0. The first CPU 200 and the second CPU 300 are interconnected for synchronous operation.

A developing unit changeover operation, in a first embodiment, according to the present invention will be described hereinafter.

First, the manner of operation of the control circuit will be described.

The developing unit selecting key 124 or 125 is operated to give a developing unit selection signal indicating the selection of the developing unit charged with toner of a desired color, namely, either the first developing unit 5 or the second developing unit 6 to the first CPU 200. Then, the first CPU 200 provides a signal indicating the color of the toner of the selected developing unit upon the reception of the developing unit selection signal to light up the corresponding LED among the LEDs 128 to 131. At this stage, the developing unit changeover operation is not started. Signals indicating a selected paper size and the number of copies to be produced also are given to the first CPU 200 by operating the corresponding keys on the control panel 100.

Then, upon the reception of a print start command signal provided by operating the print start key 102, the first CPU 200 examines the developing unit selection signal previously given thereto. When the developing unit selection signal indicates the developing unit which has been employed in the preceding copying operation and is positioned at the operative position, the first CPU 200 provides a signal to start the copying operation. Since control procedures for controlling the copying operation are the same as those executed by the known copying machine, the description thereof will be omitted. When the developing unit selection signal indicates the developing unit other than the developing unit which is at the operative position, the first CPU 200 starts control procedures for changing over the developing unit from the developing unit at the operative position to the selected developing unit, namely, control procedures for bringing the selected developing unit into an operative state and bringing the developing unit at the operative position into and inoperative state.

Since it is permitted to enter a further developing unit selection signal by operating the developing unit selecting key of the control panel during the developing unit changeover operation, the first CPU 200 monitors whether or not a further developing unit selection signal is entered during the developing unit changeover operation. If a further developing unit selection signal is entered, the first CPU decides whether or not the developing unit designated by the new developing unit selection signal is the same as the developing unit which has been designated by the preceding developing unit selection signal. If the selection signal is the same, the current developing unit changeover operation is continued and, if it is not the same, the developing unit changeover operation is interrupted and another developing unit changeover operation for bringing the developing unit designated by the new developing unit selection signal into an operative state is started.

Upon the reception of a signal indicating the completion of the developing unit changeover operation, the first CPU 200 controls the copying machine to start the copying operation.

Routines for controlling the image forming apparatus, particularly, routines for controlling the developing unit changeover operation, to be executed by the first CPU 200 will be described hereinafter with reference to FIGS. 8 and 9.

Figure 8:
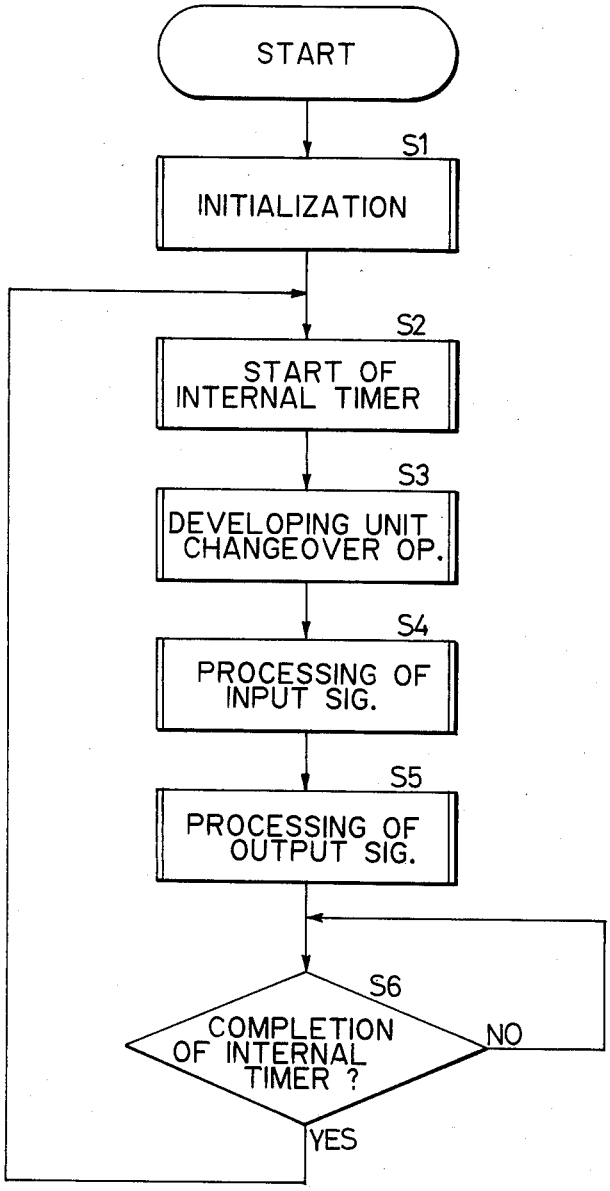
FIG. 8 is a flow chart showing the outline of the main routine executed by microprocessor of the image forming apparatus of FIG. 1.
Figure 9A:
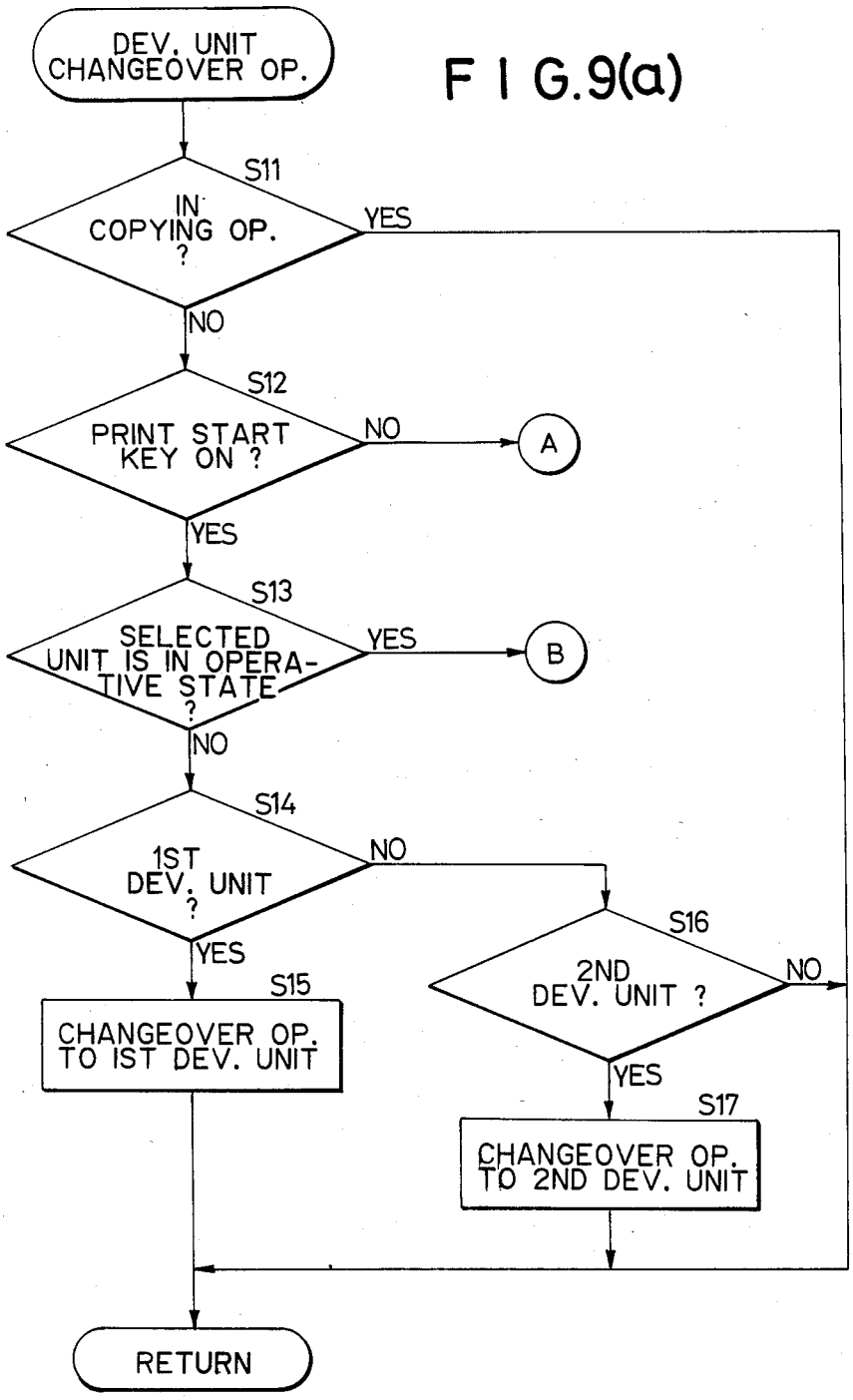
FIG. 9(*a*) and 9(*b*) is a flow chart showing a developing unit changeover routine, in a first embodiment, according to the present invention.
Figure 9B:
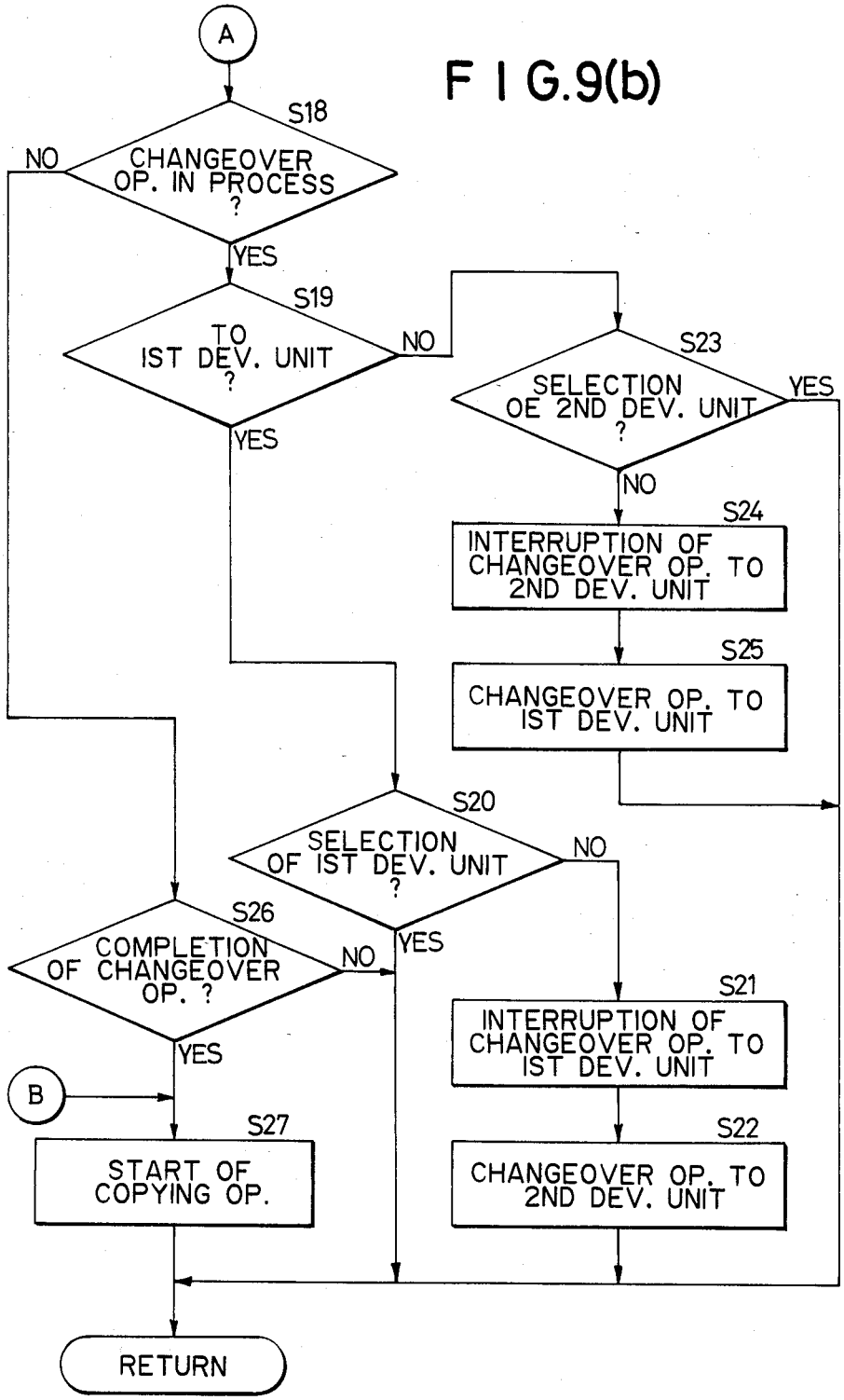

Referring to FIG. 8 showing the outline of the main routine for controlling the image forming operation, registers, timers and flags are initialized in step S1. An internal timer which defines a main routine executing time starts a timing operation in step S2. The developing unit changeover operation, which will be described in detail hereinafter, is executed in step S3. Signals received from the control panel and the detectors are processed in step S4. Control signals for controlling the copying operations of the image forming apparatus and signals for indicating the operating conditions of the image forming apparatus are provided in step S5. A decision whether or not the timing operation of the internal timer has ended is made in step S6. Upon the completion of the internal timer, the routine returns to step S2 for the next control cycle.

A developing unit changeover routine to be executed in step S3 of FIG. 8 will be described hereinafter with reference to FIG. 9.

First, a decision is made in step S11 whether or not the apparatus is in a copying operation. In case of "YES", the routine returns to the main routine without executing the developing unit changeover control procedure and, in case of "NO", a decision is made in step S12 whether or not the print start key has on and a trigger signal is issued. When the trigger signal is issued, a decision is made in step S13 whether or not the selected developing unit is the same as that which has been employed in the preceding copying operation and is in an operative state. In case of "YES", the routine goes to step S27 to start the copying operation, and then returns to the main routine and, in case of "NO", a decision is made in step S14 whether or not the first developing unit is selected. When the first developing unit is selected, the developing unit changeover operation for bringing the first developing unit into an operative state is started in step S15. When the first developing unit is not selected, a decision is made in step S16 whether or not the second developing unit is selected. When the second developing unit is selected, the developing unit changeover operation for bringing the second developing unit into an operative state is started in step S17 and, when it is not selected, the routine returns to the main routine.

When the decision in step S12 is "No", the routine goes to step S18 to make a decision whether or not the developing unit changeover operation is in process. In case of "YES", a decision is made in step S19 whether or not the developing unit changeover operation is for bringing the first developing unit into an operative state. In case of "Yes", a decision is made in step S20 whether or not the developing unit being brought to an operative state is the first developing unit selected by operating the control panel. In case of "YES", the routine returns to the main routine without executing further steps and, in case of "NO", the developing unit changeover operation for bringing the first developing unit into an operative state is interrupted in step S21, then the developing unit changeover operation for bringing the second developing unit into an operative state is started in step S22, and then the routine returns to the main routine.

When the decision in step S19 is "No", namely, when the developing unit changeover operation for bringing the second developing unit into an operative state is in process, a decision is made in step S23 whether or not the control panel is operated to select the second developing unit. In case of "YES", the routine returns to the main routine without executing further steps and, in case of "NO", the developing unit changeover operation for bringing the second developing unit into an operative state is interrupted in step S24, then the developing unit changeover operation for bringing the first developing unit into an operative state is started in step S25, and then the routine returns to the main routine.

When the decision in step S18 is "No", a decision is made in step S26 whether or not a trigger signal indicating the completion of the developing unit changeover operation is provided. In case of "YES", the developing unit changeover operation is stopped and the copying operation is started in step S27 and, in case of "NO", the routine returns to the main routine to wait for the completion of the developing unit changeover operation.

As stated hereinbefore, in the first embodiment, the first CPU 200 does not start the developing unit changeover operation immediately after the reception of a developing unit selection signal requesting the setting of a desired developing unit among a plurality of developing units, the first CPU 200 starts the developing unit changing operation upon the reception of a copy start signal given thereto by operating the print start key, and then starts the copying operation upon the completion of the developing unit changeover operation. Accordingly, the print start key can be operated immediately after the operation of the developing unit selecting key without waiting the completion of the developing unit changeover operation.

Furthermore, since a correct developing unit selection signal can be entered immediately after the perception of entering a wrong developing unit selection signal, the developing unit changeover operation for bringing the correct developing unit into an operative state can be started immediately without entering the correct developing unit selection signal after the completion of the developing unit changeover operation for bringing the wrong developing unit into an operative state. Thus, loss in time is eliminated and useless wear of the mechanical components is prevented.

Figure 10A:
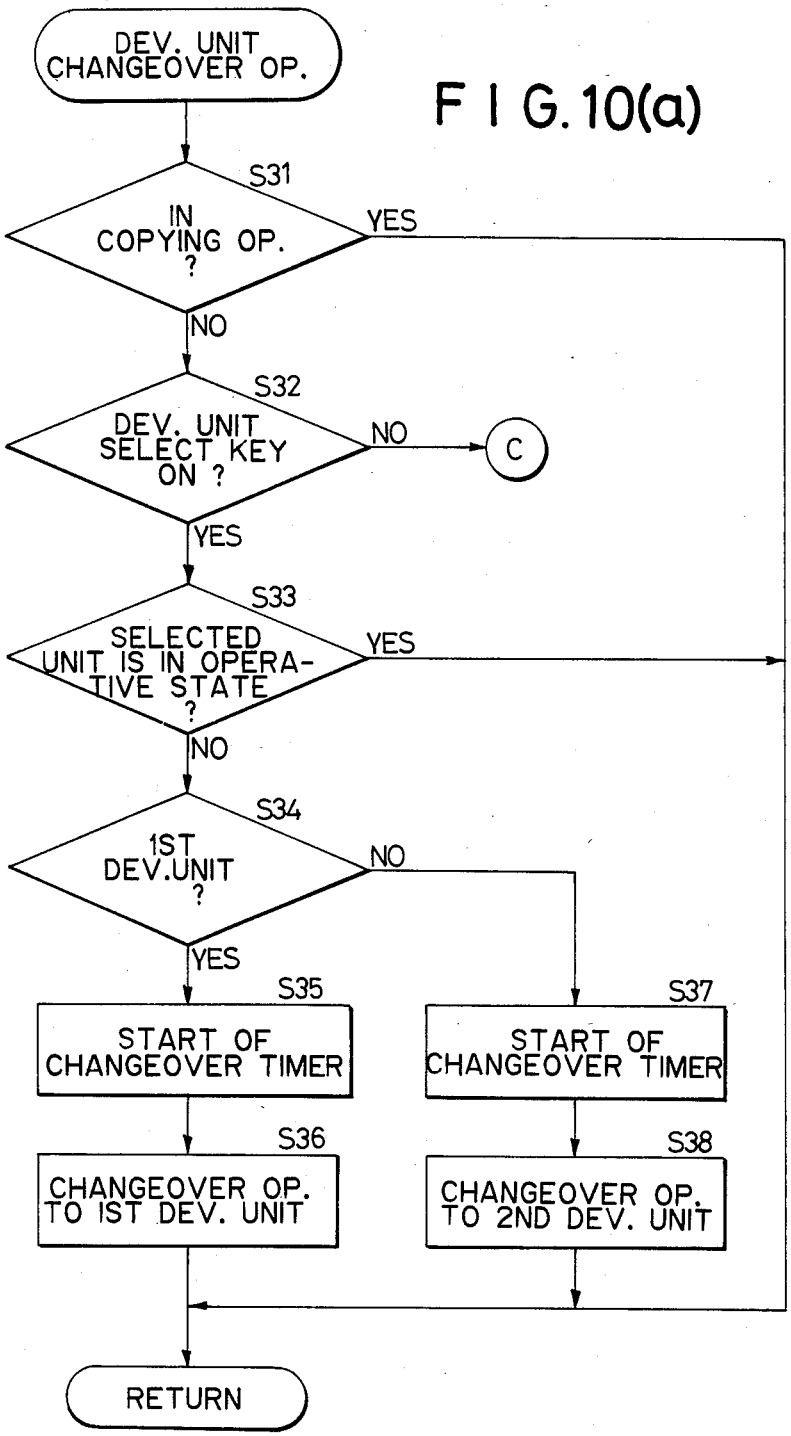
FIG. 10(*a*) and 10(*b*) is a flow chart showing a developing unit changeover routine, in a second embodiment, according to the present invention.
Figure 10B:
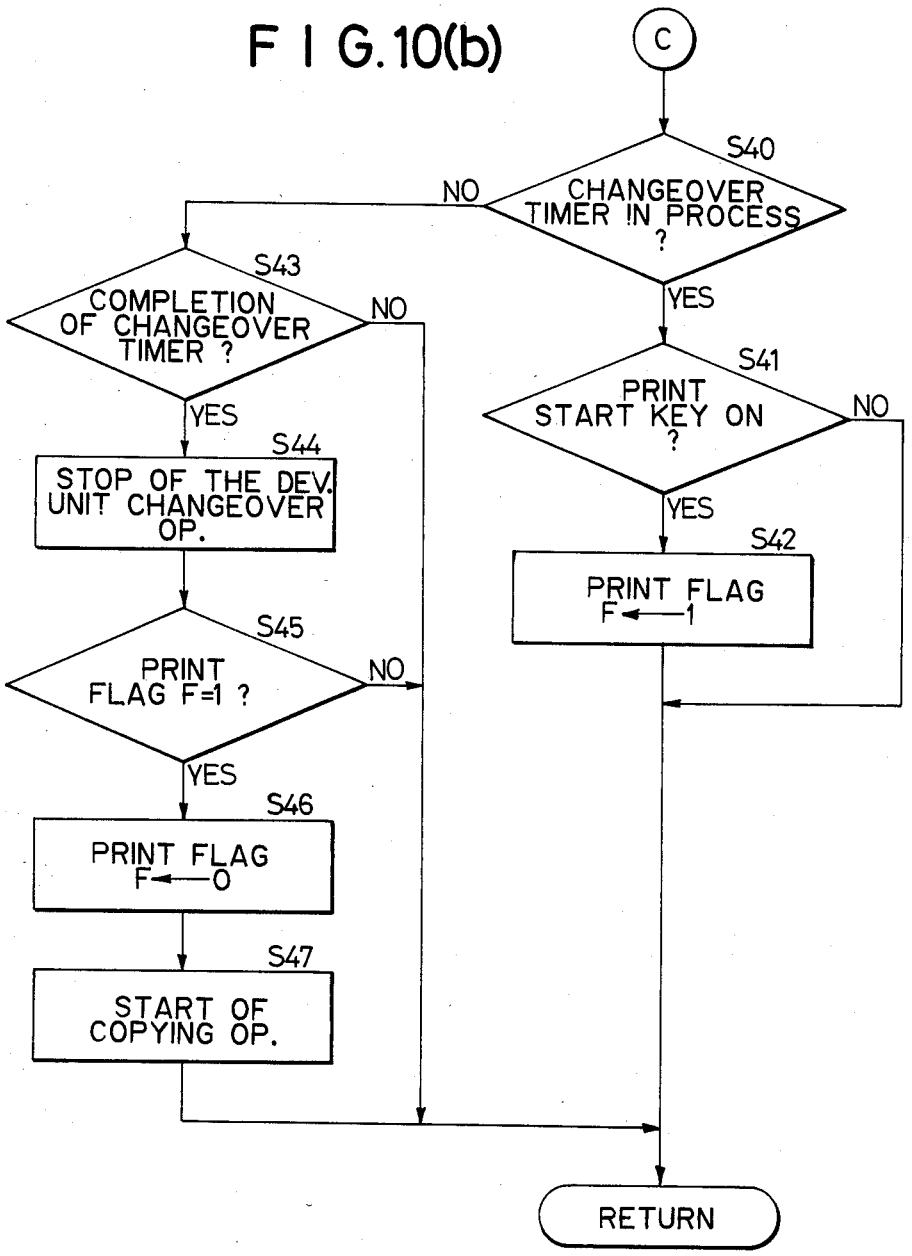

A developing unit changeover operation, in a second embodiment, according to the present invention will be described hereinafter with reference to FIG. 10.

In the second embodiment, a signal provided by operating the print start key is accepted by the first CPU 200 even during the developing unit changeover operation, and then the copying operation is started after the completion of the developing unit changeover operation.

First, the general control operation of a control circuit will be described roughly. A developing unit selection signal is given to the first CPU 200 by operating the developing unit selecting key 124 or 125 of the control panel 100 of the image forming apparatus to select a developing unit charged with toner of a desired color, namely, either the first developing unit 5 of the second developing unit 6. Signals representing a paper size and the required number of copies also are given to the first CPU 200 by operating the corresponding keys of the control panel 100.

Then, the first CPU 200 provides a signal indicating the color of the toner of the developing unit designated by the developing unit selection signal to light the corresponding LED among the LEDs 128 to 131, and then starts the developing unit changeover operation. First, a decision is made whether the selected developing unit is the same as the developing unit currently set in an operative state. If so, the developing unit changeover operation is not executed and the copying operation is started when the print start key is turned on. Procedures for controlling the copying operation and the same as those for controlling the known copying machine and hence the description thereof is omitted.

When the selected developing unit is not that which is currently in an operative state, an internal timer of the first CPU is started for timing a time necessary for the developing unit changeover operation, the selected developing unit is brought into an operative state, and then an operation for bringing the currently operative developing unit into an state is started.

When the print start key 102 is pressed to give a print start command signal to the first CPU 200 during the developing unit changeover operation, the first CPU sets a print flag to latch the print start command signal. Upon the completion of the timing operation of the internal timer defining the duration of the developing unit changeover operation, a decision is made whether or not a print flag is set, namely, whether or not the print start key is pressed. When the print flag is set, namely, when the print start key is pressed during the developing unit changeover operation, the first CPU 200 starts the copying operation upon the completion of the timing operation of the internal timer.

A developing unit changeover routine to be executed by the first CPU 200 for controlling the developing unit changeover operation will be described hereinafter with reference to FIG. 10. A main routine for controlling the image forming apparatus is the same as that described with reference to the first embodiment and hence the description thereof is omitted. The developing unit changeover routine is executed in step S3 of the main routine shown in FIG. 8.

In step S31, a decision is made whether or not the apparatus is in the copying operation. In the case of "YES", the developing unit changeover operation is not executed and the routine returns to the main routine and, in case of "NO", a decision is made in step S32 whether or not a trigger signal is provided by operating the key for selecting the first developing unit 5 or the key for selecting the second developing unit 6. In case of "YES", a decision is made in step S33 whether or not the selected developing unit is the same as that which has been used in the preceding copying operation and is in an operative state. In case of "YES", since the developing unit changeover operation need not be executed, the routine returns to the main routine and, in case of "NO", a decision is made in step S34 whether or not the first developing unit 5 is selected. When the first developing unit 5 is selected, the internal timer for time counting of the developing unit changeover operation is started in step S35, then the developing unit changeover operation for bringing the first developing unit operative is started in step S36, and then the routine returns to the main routine. When the first developing unit 5 is not selected, namely, when the second developing unit 6 is selected, the internal timer for timing the developing unit changeover operation is started in step S37, then the developing unit changeover operation for bringing the second developing unit 6 into an operative state is started in step S38, and then the routine returns to the main routine.

When the decision in step S32 is "NO", namely, when any developing unit selecting key is not operated and no trigger signal is given to the first CPU 200, a decision is made in step S40 whether or not the timing operation of the internal timer is in process. In case of "YES", a decision is made in step S41 whether or not the print start key is operated to give a trigger signal. When the trigger signal is given to the first CPU 200, a print flag F is set for "1" in step S42, and then the routine returns to the main routine. When the decision in step S41 is "NO", the routine returns directly to the main routine.

When the decision in step S40 is "No", namely, when the internal timer is not in the timing operation, a decision is made in step S43 whether or not a trigger signal indicating the completion of the time counting of the internal timer for time counting of the changeover operation is provided. When no trigger signal is provided, the routine returns to the main routine; when the trigger signal is provided, the developing unit changeover operation is stopped in step S44, and then a decision is made in step S45 whether or not the print flag F is "1". When the print flag $F=1$, the print flag F is reset for "0" in step S46, then the copying operation is started in step S47, and then the routine returns to the main routine. When the print flag $F \neq 1$, the routine returns directly to the main routine.

As stated above, in the second embodiment, upon the reception of a developing unit selection signal for selecting a desired developing unit among a plurality of developing units, the first CPU 200 starts the developing unit changeover operation. When a print start signal is given to the first CPU 200 during the developing unit changeover operation, the print start signal is latched until the completion of the developing unit changeover operation and, upon the completion of the developing unit changeover operation, the latched print start signal is brought valid to start the copying operation. Accordingly, the print start key may be operated immediately after the developing unit selection key has been operation without waiting until the completion of the developing unit changeover operation.

Figure 11A:
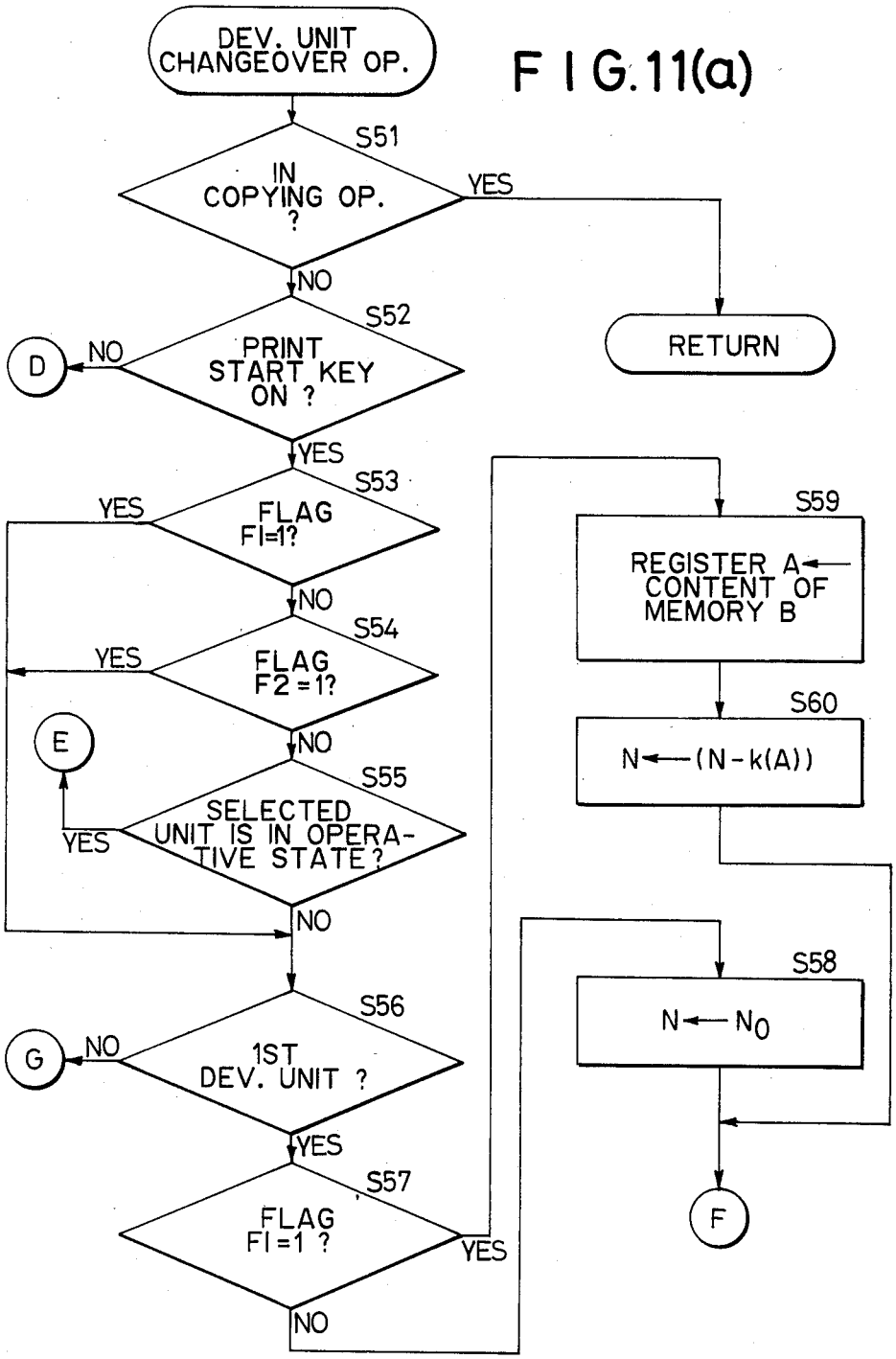
FIG. 11(*a*) and 11(*c*) is a flow chart showing a developing unit changeover routine, in a third embodiment, according to the present invention.
Figure 11B:
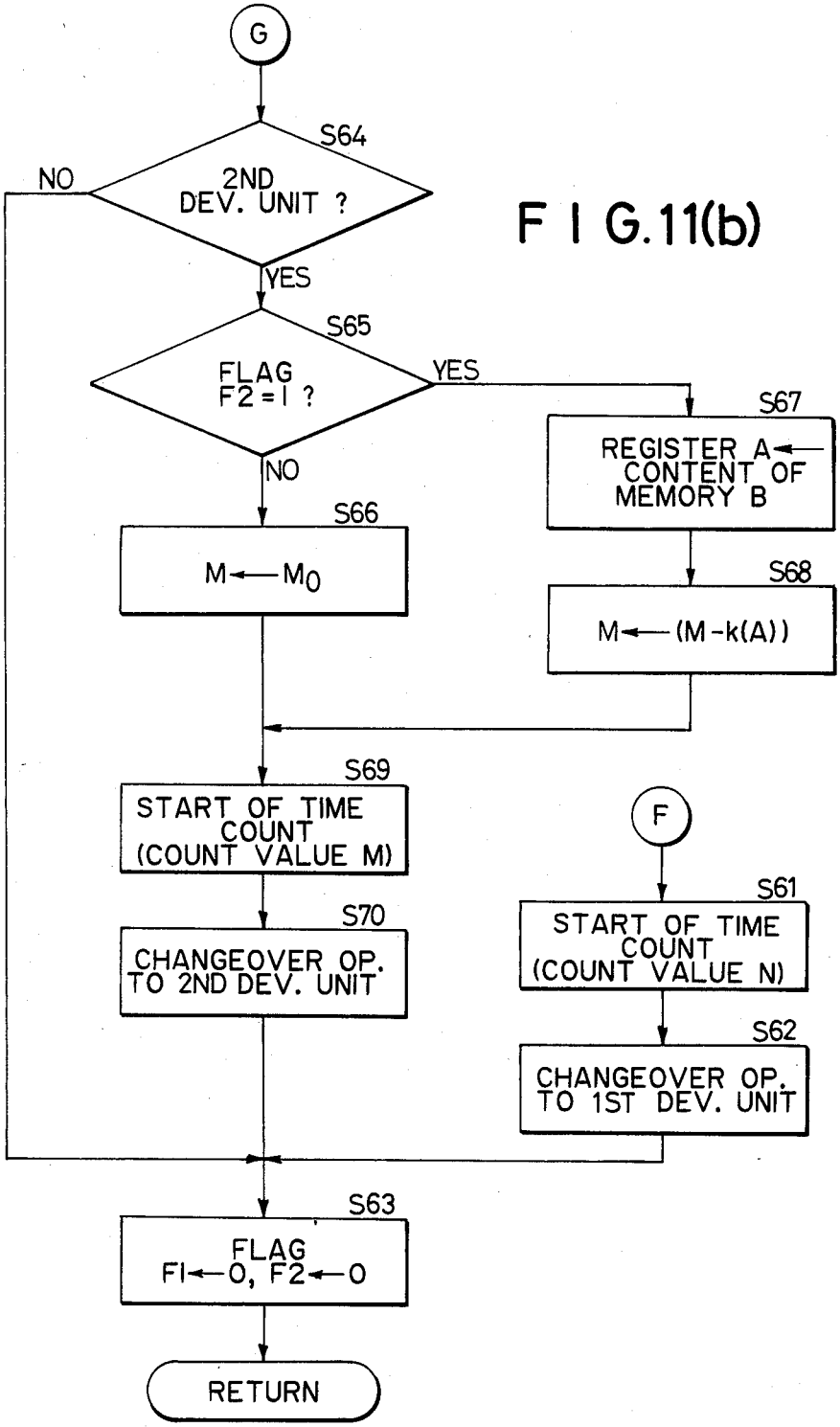
Figure 11C:
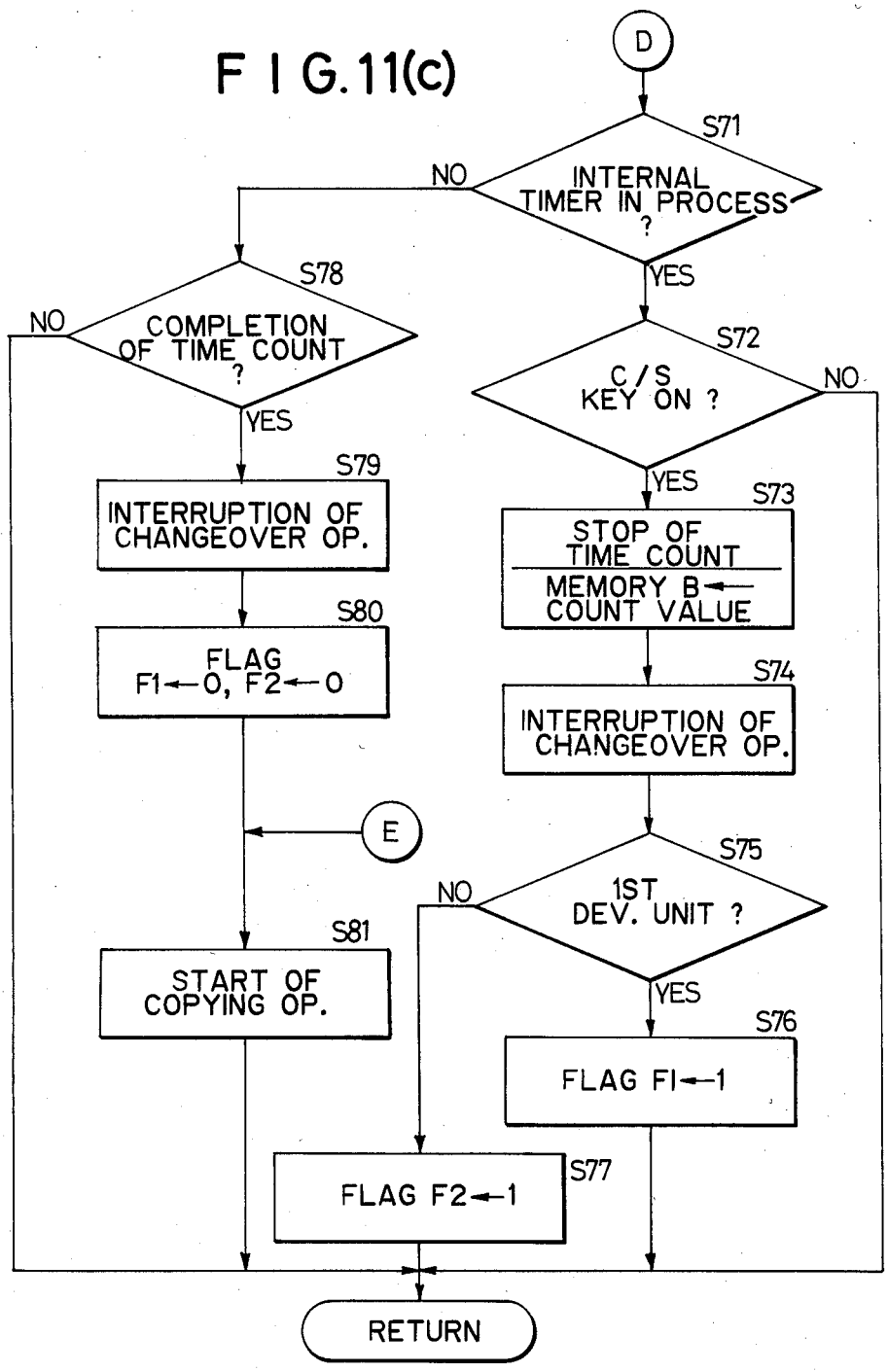

A developing unit changeover operation, in a third embodiment, according to the present invention will be described hereinafter with reference to FIG. 11.

The third embodiment avoids the repetition of steps of the developing unit changeover operation for bringing a developing unit into an operative state which have been executed before the same developing unit changeover operation is interrupted, when the developing unit changeover operation is interrupted, and the same developing unit is selected.

First, the manner of operation of the control circuit will be described.

A developing unit selection signal is given to the first CPU 200 by operating the developing unit selecting key 124 for selecting the first developing unit 5 or the developing unit selecting key 125 for selecting the second developing unit 6 to select a developing unit charged with toner of a desired color among the first developing unit 5 and the second developing unit 6. Signals representing a paper size and the required number of copies also are given to the first CPU 200.

Upon the reception of the developing unit selection signal and the print start command signal, the first CPU 200 decides whether or not the developing unit designated by the developing unit selection signal is the same as that which is currently in an operative state and, if it is the same, the first CPU 200 starts the copying operation immediately. Procedures for controlling the copying operation are the same as those for controlling a known copying machine, and hence the description thereof will be omitted. When the selected developing unit is not the currently operative developing unit, a decision is made whether the first developing unit is selected or the second developing unit is selected. Then, an internal timer is set for a predetermined developing unit changeover time specific to the selected developing unit, namely, the first developing unit or the second developing unit, and is started for timing operation. At the same time, a signal representing the color of toner of the selected developing unit is provided to light up a corresponding LED among the LEDs 128 to 131 and the developing unit changeover operation for bringing the selected developing unit operative is started.

Upon the perception of selecting a wrong developing unit during the timing operation of the internal timer, the clear/stop key 105 is pressed to give a developing unit changeover operation interruption signal to the first CPU 200. Upon the reception of the developing unit changeover operation interruption signal, the first CPU stops the timing operation of the interval timer, stores the current count value of the internal timer representing a time elapsed from the start to the interruption of the developing unit changeover operation in a memory B, and then interrupts the developing unit changeover operation.

When a developing unit selection signal designating the selection of the same developing unit as that which has been being brought into an inoperative state through the interrupted developing unit changeover operation is given to the first CPU 200 to select the same developing unit again and the print start key is operated to give a print start signal to the first CPU 200, the first CPU 200 reads the time elapsed from the start to the interruption of the preceding developing unit changeover operation from the memory B, sets the internal timer for a time obtained by subtracting the product of the time elapsed and a predetermined safety factor from a predetermined standard developing unit changeover time, starts the internal timer for timing operation, and starts the developing unit changeover operation. Thus, the time for the subsequent developing unit changeover operation is reduced by a time spent for carrying out some of the developing unit changeover procedures including a procedure for recovering the toner before a moment when the preceding developing unit changeover operation was interrupted.

Upon the completion of the time counting of the internal timer, the first CPU 200 starts the copying operation.

A control routine to be executed by the first CPU 200 for controlling the developing unit changeover operation will be described hereinafter with reference to FIG. 11. A main routine for controlling the image forming apparatus to be executed in the third embodiment is the same as that executed by the first embodiment, and hence the description thereof will be omitted. The developing unit changeover routine which will be described hereinafter is executed in step S3 of the control routine shown in FIG. 8.

First, a decision is made in step S51 whether or not the copying operation is in process. In case of "YES", the routine returns to the main routine without executing any control procedure for the developing unit changeover operation and, in case of "NO", a decision is made in step S52 whether or not the print start key is on to give a trigger signal to the first CPU 200. In case of "YES", a decision is made in step S53 whether or not a flag F1, which will be described later, is "1". When F1 $\neq 1$, the routine goes to step S54 and, when F1$=1$, the routine goes to step S56. In step S54 a decision is made whether or not a flag F2, which will be described later, is "1". When F2$\neq 1$, the routine gives to step S55 and, when F2$=1$, the routine goes to step S56. In step S55, a decision is made whether or not the selected developing unit is the same as that which has been used for the preceding copying operation and is currently in an operative state. In case of "YES", routine goes to step S81 and starts the copying operation. When the decision is step S55 is "No", a decision is made in step S56 whether or not the first developing unit is selected. In case of "YES", a decision is made in step S57 whether or not the flag F1$=1$. When F1$\neq 1$, the count value N of the internal timer is set for a predetermined count value $N_0$ in step S58 and, when F1$=1$, the count value stored in the memory B, which will be described later, is transferred to a register A in step S59, and then the contents (A) of the register A are multiplied by a constant k, for example, k$=0.8$, and the product k·(1) is subtracted from the predetermined count $N_0$ to set the internal timer for a count value $N=(N_0-k\cdot(A))$ in step S60. Then, the internal timer starts the time count operation corresponding to the count value N in step S61, then the developing unit changeover operation for bringing the first developing unit operative is started in step S62, then the flags F1 and F2 are reset for "0" in step S63, and then the routine returns to the main routine.

When the decision in step S56 is "No", namely, when the first developing unit is not selected, a decision is made in step S64 whether or not the second development unit is selected. In case of "NO" the, routine goes to step S63 and resets the flag F1 and F2 and the routine returns to the main routine and, in case of "YES", a decision is made in step S65 whether or not the flag F2$=1$. When F2$\neq 1$, the internal timer is set for a predetermined count $M_0$ in step S66 as a count M to be counted by the internal timer and, when F2$=1$, the count value stored in the memory B is transferred to the register A in step S67, and then the contents (A) of the register A is multiplied by a constant k, for example, k$=0.8$, and the product k·(A) is subtracted from the predetermined count $M_0$ to set the internal timer for a count $M=M_0-k\cdot(A)$ in step S68. The internal timer starts the time count operation corresponding to the count value M in step S69, then the developing unit changeover operation for bringing the second developing unit into an operative state is started in step S70, and then the routine goes to step S63.

When the decision is step S52 is "No", namely, when no trigger signal is given to the first CPU 200, a decision is made in step S71 whether or not the time count operation of the internal timer is in process. In case of "YES", a decision is made in step S72, whether or not the clear/stop key is operated for interrupting the developing unit changeover operation which has already been started. When the clear/stop key is not operated, namely, when any command to interrupt the developing unit changeover operation is not provided, the routine returns to the main routine. When the clear/stop key is operated, the time count operation of the internal timer is stopped and the current count value of the internal timer is stored in the memory B in step S73, and then the developing unit changeover operation is interrupted in step S74. Then, a decision is made in step S75 whether or not the developing unit which has been subjected to the interrupted developing unit changeover operation is the first developing unit. In case of "YES", the flag F1 is set for "1" in step S76 and, in case of "NO", namely, when the developing unit is the second developing unit, the flag F2 is set for "1" in step S77. Preparation for reducing the predetermined developing unit changeover time for bringing the same developing unit as that which has been subjected to the interrupted developing unit changeover operation by a time spent for executing steps S57 to S60 and steps S65 to S68 before the preceding developing unit changeover operation was interrupted is accomplished through steps S72 to S77, when the same developing unit is selected after the interruption of the developing unit changeover operation.

When the decision in step S71 is "No", namely, when the internal timer is not in the timing operation, a decision is made in step S78 whether or not a trigger signal which is to be provided upon the end of the timing operation of the internal timer is provided. In case of "NO", the routine returns to the main routine and, in case of "YES", the developing unit changeover operation is interrupted in step S79, then the flags F1 and F2 are reset for "0" in step S80, and then the copying operation is started in step S81.

Thus, according to the third embodiment of the present invention, when a developing unit selection signal for selecting a desired developing unit among a plurality of developing units is given to the first CPU 200 and the print start key is turned on, the internal timer is set for a predetermined developing unit changeover time, and then the developing unit changeover operation is started. However, when the developing unit changeover operation is interrupted and the same developing unit as that which has been subjected to the interrupted developing unit changeover operation is selected again, the predetermined developing unit into an changeover time for bringing the same developing unit operative state is reduced by a time spent in the interrupted developing unit changeover operation for procedures including a procedure for recovering the developer. Accordingly, time is not used uselessly in carrying out the developing unit changeover operation to bring the developing unit into an operative state after the interruption of the preceding developing unit changeover operation for bringing the same developing unit operative.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An image forming apparatus equipped with a plurality of developing units which are selectively bruoght into an operative state one at a time, said image forming apparatus comprising:

developing unit selecting signal input means for giving a developing unit selecting signal designating the selection of one developing unit among the plurality of developing units;

developing unit changeover means which executes a developing unit changeover operation according to the developing unit selecting signal to bring the selected developing unit into an operative state and to bring the rest of the developing units into an inoperative state; and control means for controlling said developing unit changeover means, when another developing unit selecting signal requesting the selection of another developing unit is given during the developing unit changeover operation, so as to make said developing unit changeover means interrupt the developing unit changeover operation in process and execute another developing unit changeover operation for bringing the newly selected developing unit into an operative state.

2. An image forming apparatus as claimed in claim 1, wherein said image forming apparatus further comprises an image forming operation start signal input means for giving an image forming operation start signal, and said developing unit changeover means starts the developing unit changeover operation in response to an image forming operation start signal which is given after the developing unit selecting signal has been given.

3. An image forming apparatus as claimed in claim 1, wherein said image forming apparatus further comprises image forming operation start signal input means for giving an image forming operation start signal, and, when an image forming operation start signal is given during the developing unit changeover operation, said control means latches the image forming operation start signal until the completion of the developing unit changeover operation, and then starts the image forming operation upon the completion of the developing unit changeover operation.

4. An image forming apparatus as claimed in claim 1, wherein said image forming apparatus further comprises developing unit changeover operation interrupting signal input means for giving a developing unit changeover operation interrupting signal, said control means interrupts the developing unit changeover operation in process upon the reception of a developing unit changeover operation interrupting signal, and, when a developing unit selecting signal is input during a changeover operation and that developing unit selecting signal designates the selection of the same developing unit as that which had been in an operative state immediately prior to the initiation of the changeover operation, said control means executes a control operation to accomplish the developing unit changeover operation for bringing the same developing unit into an operative state in a time shorter than a predetermined normal developing unit changeover time.

5. An image forming apparatus equipped with a plurality of developing units which are selectively brought into an operative state one at a time, said image forming apparatus comprising:

developing unit selecting signal input means for giving a developing unit selecting signal designating the selection of one developing unit among the plurality of developing units;

image forming operation start signal input means for giving an image forming operation start signal;

developing unit changeover means which executes a developing unit changeover operation according to the developing unit changeover signal to bring the selected developing unit into an operative state and to bring the rest of the developing units into an inoperative state; and control means which controls said developing unit changeover means and the start of the image forming operation according to the signals provided by said developing unit selecting signal input means and said image forming operation start signal input means, controls said developing unit changeover means, upon the reception of an image forming operation start signal which is given after a developing unit selecting signal has been given, so as to execute a developing unit changeover operation for bringing the developing unit designated by the developing unit selecting signal into an operative state and to bring the rest of the developing units into an inoperative state, and controls the start of the image forming operation so that the image forming operation is started immediately after the developing unit changeover operation has been accomplished.

6. An image forming apparatus as claimed in claim 5, wherein said control means interrupts the developing unit changeover operation in process upon the reception of another developing unit selecting signal designating the selection of another developing unit during the developing unit changeover operation, and executes the control operation for bringing the other developing unit into an operative state.

7. An image forming apparatus equipped with a plurality of developing units which are selectively brought into an operative state one at a time, said image forming apparatus comprising:

developing unit selecting signal input means for giving a developing unit selecting signal designating the selection of one developing unit among the plurality of developing units;

image forming operation start signal input means for giving an image forming operation start signal;

developing unit changeover means which executes a developing unit changeover operation according to the developing unit selecting signal to bring the selected developing unit into an operative state and to bring the rest of the developing units into an inoperative state; and control means which controls said developing unit changeover means and the start of the image forming operation according to the signals provided by said developing unit selecting signal input means and said image forming operation start signal input means, executes a control operation to start the developing unit changeover operation upon the reception of the developing unit selecting signal, and executes a control operation, when the image forming operation start signal is given during the developing unit changeover operation, to start the image forming operation after the developing unit changeover operation has been accomplished, without requiring a further image forming operation start signal.

8. An image forming apparatus equipped with a plurality of developing units which are selectively brought into an operative state one at a time, said image forming apparatus comprising:

a developing unit selecting signal input means for giving a developing unit selecting signal designating the selection of one developing unit among the plurality of developing units;

developing unit changeover means which executes a developing unit changeover operation according to the developing unit selecting signal to bring the selected developing unit into an operative state and to bring the rest of the developing units into an inoperative state;

developing changeover operation interrupting signal input means for giving a developing unit changeover operation interrupting signal for interrupting the developing unit changeover operation in process; and control means which controls said developing unit changeover means according to signals provided by said developing unit selecting signal input means and said developing unit changeover operation interrupting signal input means, interrupts the developing unit changeover operation in process upon the reception of the developing unit changeover operation interrupting signal, and executes a control operation, when a developing unit selecting signal given thereto after the interruption of the developing unit changeover operation designates the same developing unit as had been in an operative state immediately prior to the interrupted changeover operation, so as to accomplish the developing unit changeover operation in a time shorter than a predetermined normal developing unit changeover time.

9. An image forming apparatus as claimed in claim 8, wherein said control means includes timing means for allowing said developing unit changeover means to operate for a predetermined time, and the predetermined time of said timing means is reduced when a developing unit selecting signal designating the same developing unit that was in an operative state immediately preceding the changeover operation is given after the interruption of the developing unit changeover operation.

* * * * *